US005102113A

United States Patent [19]

Renner et al.

[11] Patent Number: 5,102,113

[45] Date of Patent: Apr. 7, 1992

[54] DEVICE FOR LOCKING A SUCTION NOZZLE OF A SEPARATING SUCKER ON A SUCTION HEAD OF A SHEET FEEDER

[75] Inventors: Jochen Renner; Peter Sobota, both of Heidelberg, Fed. Rep. of Germany

[73] Assignee: Heidelberger Druckmaschinen AG, Heidelberg, Fed. Rep. of Germany

[21] Appl. No.: 689,291

[22] Filed: Apr. 22, 1991

[30] Foreign Application Priority Data

Apr. 21, 1990 [DE] Fed. Rep. of Germany ..... 4012778

[51] Int. Cl.[5] ..... B65H 5/08

[52] U.S. Cl. ..... 271/14; 271/93; 271/102

[58] Field of Search ..... 271/5, 15, 104, 107, 271/108, 93, 90, 102; 414/797

[56] References Cited

U.S. PATENT DOCUMENTS 3,007,697 11/1961 Mosemiller ..... 271/90
3,931,964 1/1976 Schwebel .
3,938,800 2/1976 Witz ..... 271/93
4,786,043 11/1988 Jiruse et al. ..... 271/107

*Primary Examiner*—H. Grant Skaggs
*Attorney, Agent, or Firm*—Herbert L. Lerner; Laurence A. Greenberg

[57] ABSTRACT

A device for locking a suction nozzle of a separating sucker on a suction head of a sheet feeder of a sheet-processing machine, the suction head carrying a device for vertically moving the suction nozzle of the separating sucker, and a drive device for guiding at least one forwarding sucker reciprocatingly in accordance with a working cycle of the sheet-processing machine and substantially parallel to the plane of a sheet supplied to the feeder, including a bearing support laterally disposed on the suction nozzle, a movably arranged abutment device for supporting the bearing support, when the suction nozzle is in a lifted position, until a trailing edge of the sheet supplied to the feeder has left the vicinity of the suction nozzle of the separating sucker, and a member connecting the abutment device to the drive device for the forwarding sucker.

6 Claims, 3 Drawing Sheets

DEVICE FOR LOCKING A SUCTION NOZZLE OF A SEPARATING SUCKER ON A SUCTION HEAD OF A SHEET FEEDER

The invention relates to a device for locking a suction nozzle of a separating sucker on a suction head of a sheet feeder.

German Patent 23 09 013 discloses a device of the foregoing general type which has found application when spring suckers are used as separating suckers and when the lifting motion of the separating sucker is performed without any special drive means. In the device according to the German patent, the suction head is provided with a lever which is mounted so as to be pivotable about a horizontal axis, has a cam roller or follower cooperating with a control cam and further has, at its free end, a cross-bar for holding up the separating nozzles. A bearing support is formed by two rollers which are mounted on respective ends of the cross-bar and cooperate with flanges extending horizontally to the suction nozzles of the separating suckers. The means for locking the suction nozzle of the separating sucker thus have a separate drive with its own control cam by means of which the suction nozzle of the separating sucker is automatically moved downwardly the instant the trailing edge of the sheet supplied to the feeder has left the vicinity of the suction nozzle of the separating sucker.

German Patent 891 267 discloses a device for locking a suction nozzle of a separating sucker mounted on a suction head of a sheet feeder and executing an oscillatory motion, a pawl in the form of a double lever being pivotally mounted on the separating sucker, one arm of the lever having an abutment for a nose or projecting part provided on the suction nozzle, and the other arm cooperating with a stop provided on a pile detector or sensor. The separating sucker is constructed as a spring sucker so that, in a rear swivel position thereof, the suction nozzle springs upwardly after it has sucked in the uppermost sheet on the sheet pile, and the abutment of the pawl then engages behind the nose or projecting part of the suction nozzle and holds it in the upper position until the trailing edge of the sheet supplied to the feeder has left the vicinity of the suction nozzle which has been aerated in the interim. Upon the return of the separating sucker which, together with the suction nozzle, moves oscillatingly on a sheet path into the rear end position, the stop provided on the pile detector or sensor releases the locking mechanism so that the suction nozzle drops downwardly.

It is accordingly an object of the invention to provide a mechanism for locking a separating sucker formed as a spring sucker, in an upper end position, with a forcibly controlled release of a suction nozzle in accordance with a working cycle of the suction head, which avoids the disadvantages of heretofore known devices of this general type.

With the foregoing and other objects in view, there are provided, in accordance with the invention, a device for locking a suction nozzle of a separating sucker on a suction head of a sheet feeder of a sheet-processing machine, the suction head carrying means operatable by suction air and spring force for vertically moving the suction nozzle of the separating sucker, and drive means for guiding at least one forwarding sucker reciprocatingly in accordance with a working cycle of the sheet-processing machine and substantially parallel to the plane of a sheet supplied to the feeder, comprising a bearing support laterally disposed on the suction nozzle, movably arranged abutment means for supporting the bearing support, when the suction nozzle is in a lifted position, until a trailing edge of the sheet supplied to the feeder has left the vicinity of the suction nozzle of the separating sucker, and a member connecting the abutment means to the drive means for the forwarding sucker.

Such a construction requires neither an additional drive nor an additional control for locking the separating sucker in the lifted position thereof. The abutment or counter-support is moved forcibly together with the forwarding sucker so that the bearing support provided on the suction nozzle is released only before the trailing edge of the uppermost sheet supplied to the feeder has left the vicinity of the suction nozzle of the separating sucker, and the following sheet is to be lifted from the sheet pile. The suction nozzle of the separating sucker then drops downwardly due to its own weight and, if necessary or desirable, with the aid of a spring force and, under the influence of negative pressure or partial vacuum in the separating sucker, springs upwardly again into the upper end position thereof where it is relocked before the negative pressure or partial vacuum in the separating sucker is cut off or terminated and the sheet is advanced into the feeder.

A particular advantage of such a construction is that the motion of the abutment which causes the locking of the suction nozzle of the separating sucker is controlled, by means of a relatively small number of structural parts, directly by the motion of the forwarding-sucker, and thus also depends upon the forwarding-sucker motion.

Thus, in accordance with another feature of the invention, the member is a structural component of the drive means for the forwarding sucker, the structural component being guidable horizontally and substantially parallel to the plane of the sheet supplied to a sheet pile of the feeder, the abutment means being formed with a control edge for releasing the bearing support in a forward motion range of the forwarding sucker just before it has reached a front end position of the forward motion thereof, and for re-locking the bearing support immediately after returning motion of the forwarding sucker has begun.

In accordance with a concomitant feature of the invention, the abutment means comprise a pin fastened to the forwarding sucker, the pin having an end cooperatively engageable with the bearing support.

As is readily apparent, the application of the features of the invention is independent of the number of separating suckers or forwarding suckers which are provided.

Other features which are considered as characteristic for the invention are set forth in the appended claims.

Although the invention is illustrated and described herein as embodied in a device for locking a suction nozzle of a separating sucker on a suction head of a sheet feeder, it is nevertheless not intended to be limited to the details shown, since various modifications and structural changes may be made therein without departing from the spirit of the invention and within the scope and range of equivalents of the claims.

The construction and method of operation of the invention, however, together with additional objects and advantages thereof will be best understood from the following description of specific embodiments when read in connection with the accompanying drawings, in which.

Figure 1:
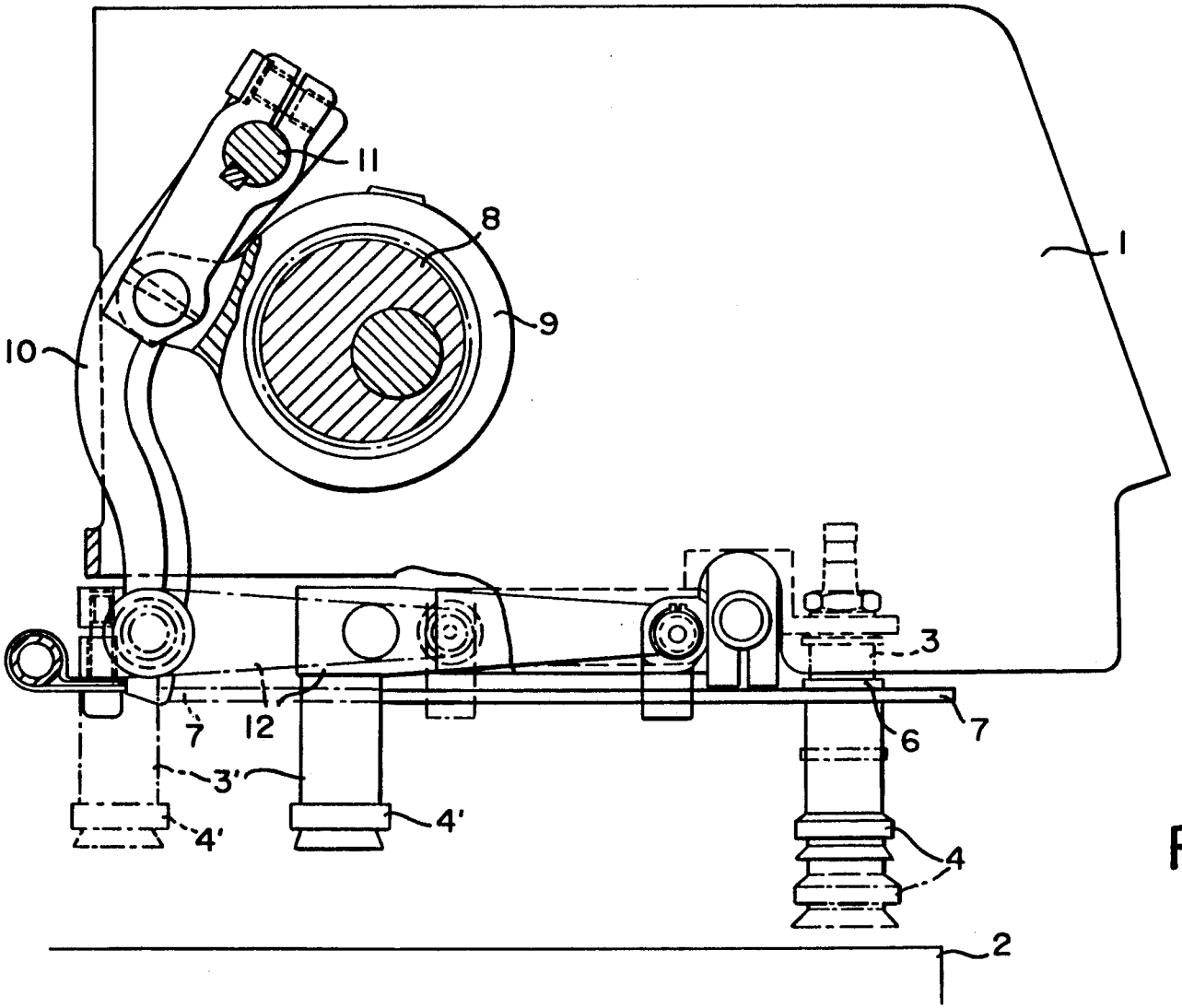
FIG. 1 is a side elevational view, partly in section, of a suction head of a sheet feeder.
Figure 2:
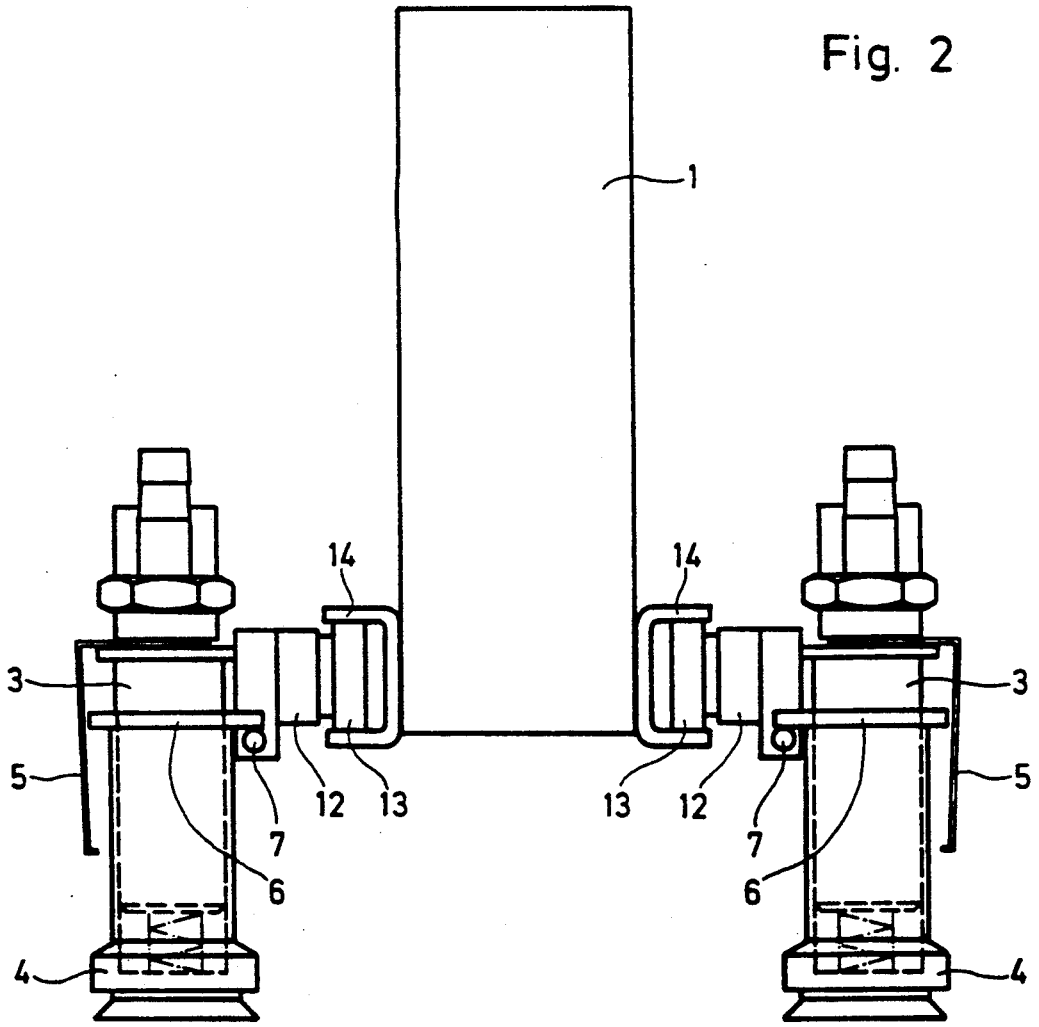
FIG. 2 is a slightly enlarged rear elevational view of the suction head as seen from the right-hand side of FIG. 1.

Referring now to the drawing and, first, particularly to FIG. 1 thereof, there is shown, in a region above a trailing end of a sheet on a sheet pile 2, a suction head 1 is provided with one or more separating suckers 3 which are arranged adjacent and spaced apart from one another transversely to the conveying direction of the sheets in the sheet feeder. The separating sucker 3 is constructed as a spring sucker, so that the suction nozzle 4, which is guided on the separating sucker so as to be vertically movable, drops into the lower sucking position represented in phantom in FIG. 1, either due to its own weight alone or, if necessary or desirable, with the aid of an internal spring. This lower end position of the suction nozzle 4 is maintained by a guide spring 5 shown in FIG. 2 which simultaneously secures the suction nozzle against rotation. Laterally to the suction nozzle 4, there is provided a bearing support 6 for an abutment 7 which serves for locking the suction nozzle 4 in the lifted position of the latter shown in solid lines in FIG. 1. The abutment 7 is guided so as to be horizontally movable and is connected to a drive for moving forwarding or pull suckers 4'. The forwarding suckers 4' have respective suction nozzles 3' which are movable horizontally. In the embodiment of the invention shown in FIG. 1, the horizontal motion of the forwarding or pull suckers 4' is effected via an eccentric drive made up of a rotating eccentric disk 8 moving in a ring 9 which is articulatingly connected to a rocking lever 10 having at one end thereof a self-aligning or swing bearing 11 on the suction head 1. The other end of the rocking lever 10 is articulatingly connected to one end of a roller lever 12 which, together with a roller 13 (FIG. 2) rotatably mounted on the other end of the roller lever 12, is guided in a guide 14 arranged horizontally on the suction head 1 so that a horizontal reciprocating motion of the forwarding or pull sucker 4' is achieved. A locking pin which forms the abutment 7 of the bearing support 6 is connected to the roller lever 12 on each side of the suction head 1 and, thereby, to the forwarding suckers 4', the locking pin 7 extending horizontally and being of such length that the bearing support 6 on the suction nozzle 4 is released when the forwarding or pull suckers 4' are in a forward position of motion at the left-hand side of FIG. 1, and a new sheet may be lifted from the sheet pile 2. Immediately after the returning movement of the forwarding sucker 4' has begun, the free end of the locking pin 7 engages beneath the bearing support 6 of the suction nozzle 4 so that the suction nozzle 4 is locked in the upper position thereon shown in solid lines in FIG. 1 before the partial vacuum in the separating sucker 3 is cut off or broken. In FIG. 1 of the drawing, the position of the locking pin 7 when the suction nozzle 4 of the separating sucker 3 is released is shown in phantom. The position of the locking pin 7 when the suction nozzle 4 is locked in the upper end position thereof is indicated by solid lines. A particular advantage of the embodiment of the invention illustrated in FIGS. 1 and 2 is that the means for locking the separating sucker 3, which is constructed as a spring sucker, are formed of simple structural components.

Figure 3:
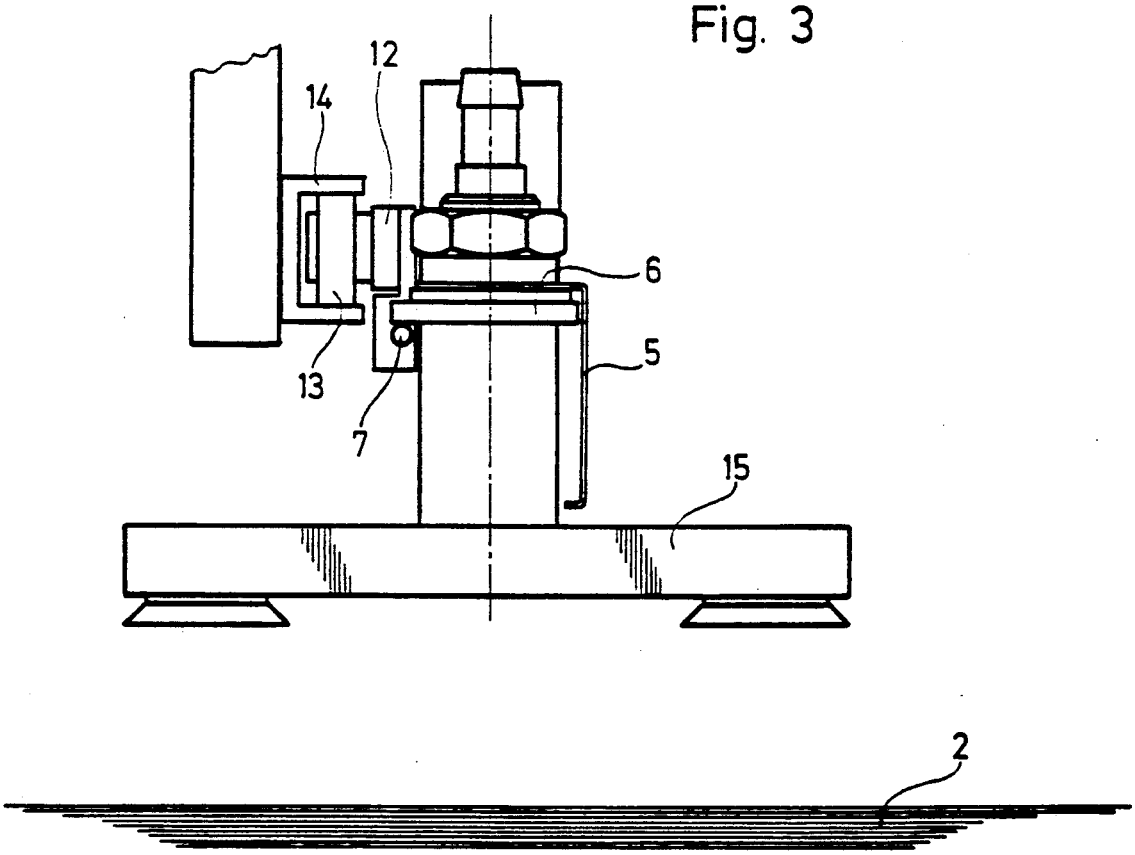
FIG. 3 is a slightly enlarged fragmentary view of FIG. 2 showing an alternative embodiment of the suction head.

In another and alternative embodiment of the invention which is illustrated in FIG. 3, a single centrically arranged separating sucker 3 having a double spring sucker 15 is provided.

We claim:

1. Device for locking a suction nozzle of a separating sucker on a suction head of a sheet feeder of a sheet-processing machine, the suction head carrying means for vertically moving the suction nozzle of the separating sucker, and drive means for guiding at least one forwarding sucker reciprocatingly in accordance with a working cycle of the sheet-processing machine and substantially parallel to the plane of a sheet supplied to the feeder, comprising a bearing support laterally disposed on the suction nozzle, movably arranged abutment means for supporting said bearing support, when the suction nozzle is in a lifted position, until a trailing edge of the sheet supplied to the feeder has left the vicinity of the suction nozzle of the separating sucker, and a member connecting said abutment means to the drive means for the forwarding sucker.

2. Device according to claim 1, wherein said abutment means are formed with a control edge for releasing and re-engaging said bearing support in accordance with the reciprocating motion of the forwarding sucker.

3. Device according to claim 1, wherein said abutment means comprise a pin fastened to the forwarding sucker, said pin having an end cooperatively engageable with said bearing support.

4. Device according to claim 1, including means for operating the suction head carrying means by suction air.

5. Device according to claim 4, including spring means for supplementarily operating the suction head carrying means by spring force.

6. Device according to claim 1, wherein said member is a structural component of the drive means for the forwarding sucker, said structural component being guidable horizontally and substantially parallel to the plane of the sheet supplied to a sheet pile of the feeder, said abutment means being formed with a control edge for releasing said bearing support in a forward motion range of the forwarding sucker just before it has reached a front end position of the forward motion thereof, and for re-locking said bearing support immediately after a returning motion of the forwarding sucker has begun.

* * * * *